US005839161A

United States Patent [19]

Liang

[11] Patent Number: 5,839,161

[45] Date of Patent: Nov. 24, 1998

[54] SUCTION PIPE ASSEMBLY FOR A VACUUM CLEANER

[75] Inventor: Wen-Tsung Liang, Feng-Yuan, Taiwan

[73] Assignee: Choung Cheng Industrial Co., Ltd., Taichung Hsien, Taiwan

[21] Appl. No.: 864,071

[22] Filed: May 28, 1997

[51] Int. Cl.[6] ..... A47L 9/06

[52] U.S. Cl. ..... 15/398; 15/393; 15/415.1

[58] Field of Search ..... 15/363, 393, 398, 15/400, 414, 415.1

[56] References Cited

U.S. PATENT DOCUMENTS

| | | | |
|---|---|---|---|
| 1,474,875 | 11/1923 | Adams | 15/400 |
| 2,715,240 | 8/1955 | Pieper et al. | 15/415.1 |
| 5,048,149 | 9/1991 | Heinen | 15/415.1 |
| 5,502,870 | 4/1996 | Ragner et al. | 15/398 |
| 5,652,997 | 8/1997 | Na | 15/400 |

*Primary Examiner*—Terrence Till

*Attorney, Agent, or Firm*—Finnegan, Henderson, Farabow, Garrett & Dunner, L.L.P.

[57] ABSTRACT

A suction pipe assembly for a vacuum cleaner includes a suction pipe body and a brush member. The suction pipe body is provided with a distal open end portion. The brush member includes a brush base which has a generally U-shaped cross section, a rear section that straddles the distal open end portion of the pipe body and that has opposite lateral side portions pivoted respectively to two diametrically opposite positions of the distal open end portion of the pipe body, and a front section with a distal front end face. The brush member further includes a plurality of bristles provided on the front end face of the front section of the brush base. The brush base is pivotable with respect to the distal open end portion of the pipe body between a position of use, wherein the front section of the brush base extends frontwardly relative to the distal open end portion of the pipe body, and a storing position, wherein the front section of the brush base straddles the pipe body. The brush base can be retained releasably on the pipe body at the position of use and the storing position.

4 Claims, 7 Drawing Sheets

SUCTION PIPE ASSEMBLY FOR A VACUUM CLEANER

BACKGROUND OF THE INVENTION

1. Field of the Invention

The invention relates to a vacuum cleaner, more particularly to a suction pipe assembly for a vacuum cleaner.

2. Description of the Related Art

Referring to FIG. 1, a conventional suction pipe assembly for a vacuum cleaner 10 includes a pipe body (not shown) adapted to be attached to one end of a flexible hose 13, and a suction head 12 or a brush member 11 mounted detachably and selectively on the distal open end portion of the pipe body.

A disadvantage of the aforesaid suction pipe assembly resides in that the brush member 11 may be misplaced because it is normally detached from the pipe body, thereby inconveniencing the user.

SUMMARY OF THE INVENTION

The object of this invention is to provide a suction pipe assembly for a vacuum cleaner which has a brush member mounted pivotally on a pipe body in such a manner that the brush member will not be misplaced.

Accordingly, the suction pipe assembly for a vacuum cleaner of this invention includes a pipe body and a brush member. The pipe body has a distal open end portion. The brush member includes a brush base which has a generally U-shaped cross section, a rear section that straddles the distal open end portion of the pipe body and that has opposite lateral side portions pivoted respectively to two diametrically opposite positions of the distal open end portion of the pipe body, and a front section with a distal front end face. The brush member further includes a plurality of bristles provided on the front end face of the front section of the brush base. The brush base is pivotable with respect to the distal open end portion of the pipe body between a position of use, wherein the front section of the brush base extends frontwardly relative to the distal open end portion of the pipe body, and a storing position, wherein the front section of the brush base straddles the pipe body. The suction pipe assembly further includes retaining means for retaining releasably the brush base on the pipe body at the position of use and the storing position.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
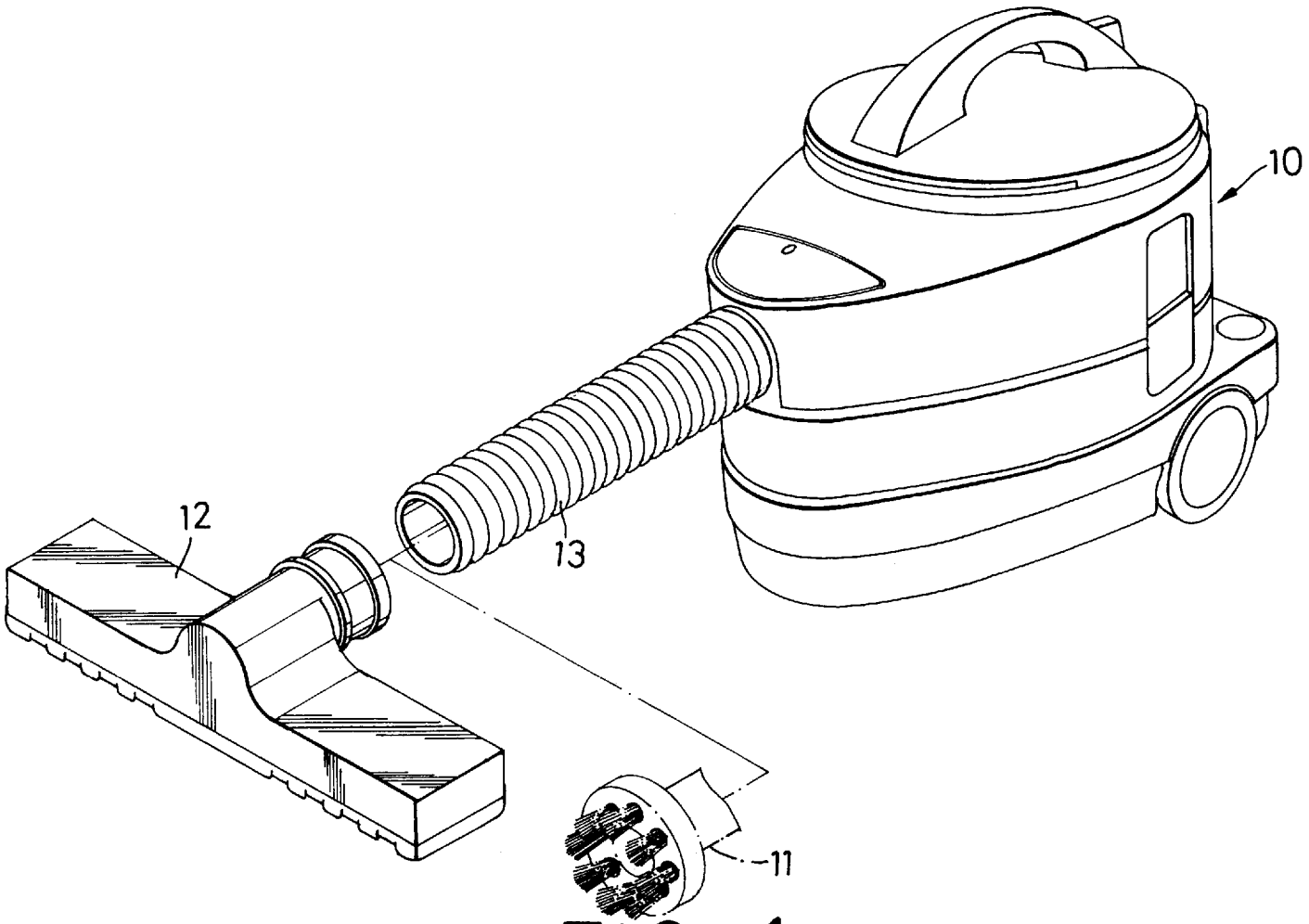
FIG. 1 PRIOR ART
FIG. 1 illustrates a conventional vacuum cleaner.
Figure 2:
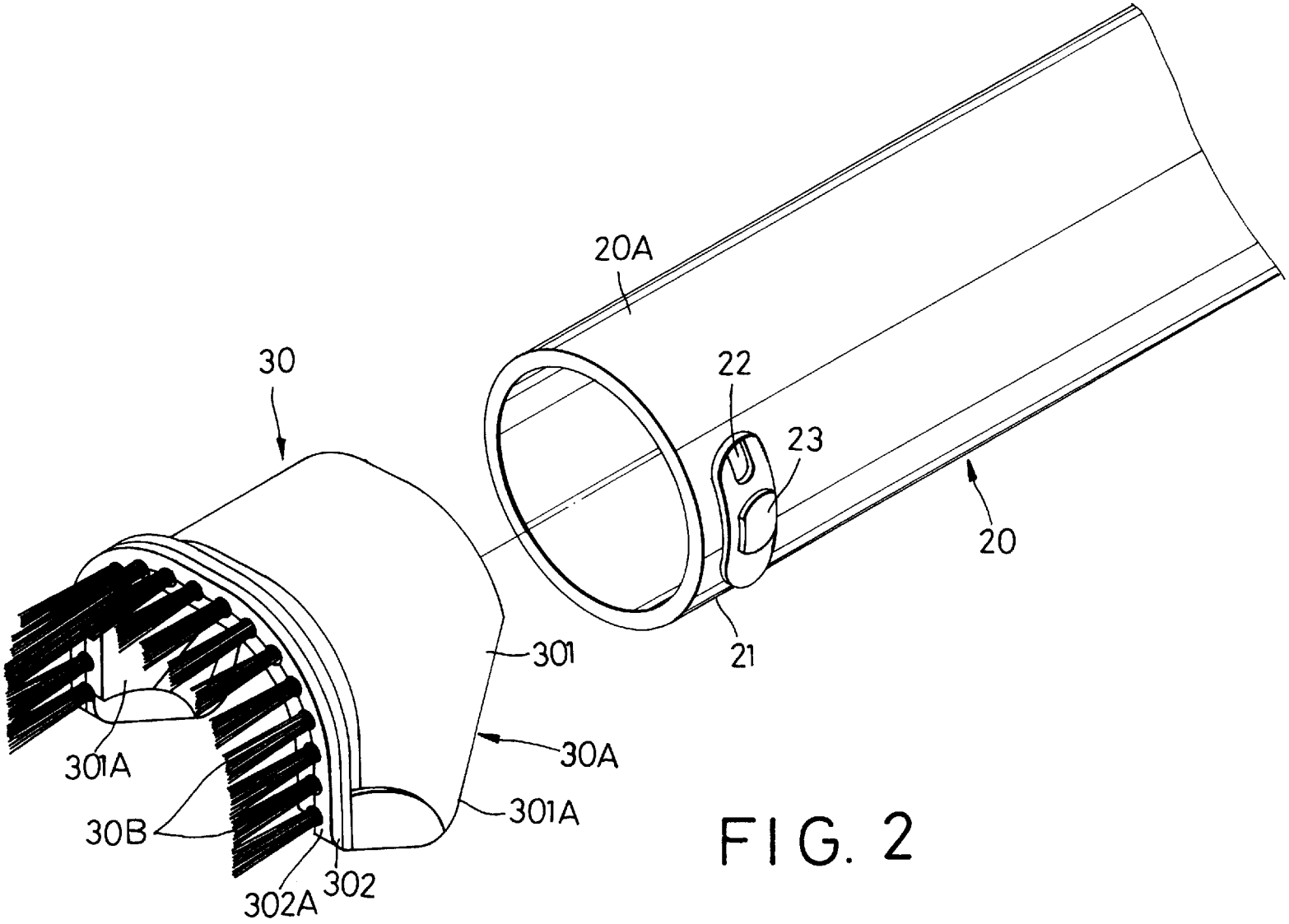
FIG. 2 is an exploded view of the preferred embodiment of a suction pipe assembly of this invention.
Figure 3:
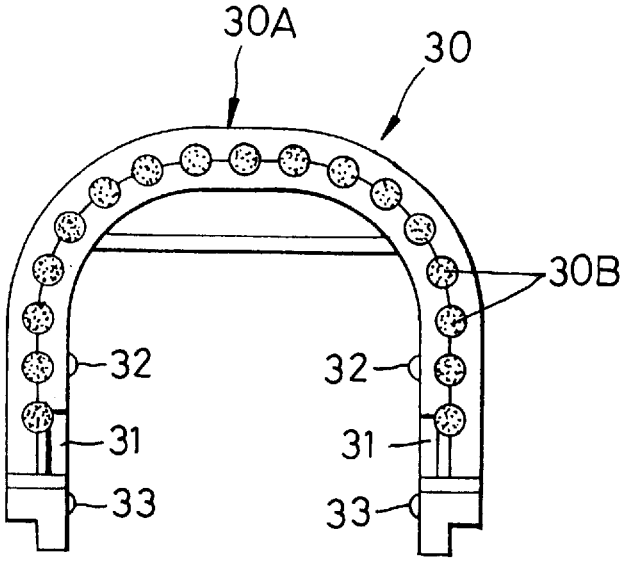
FIG. 3 is a front view of a brush member employed in the preferred embodiment of this invention.
Figure 4:
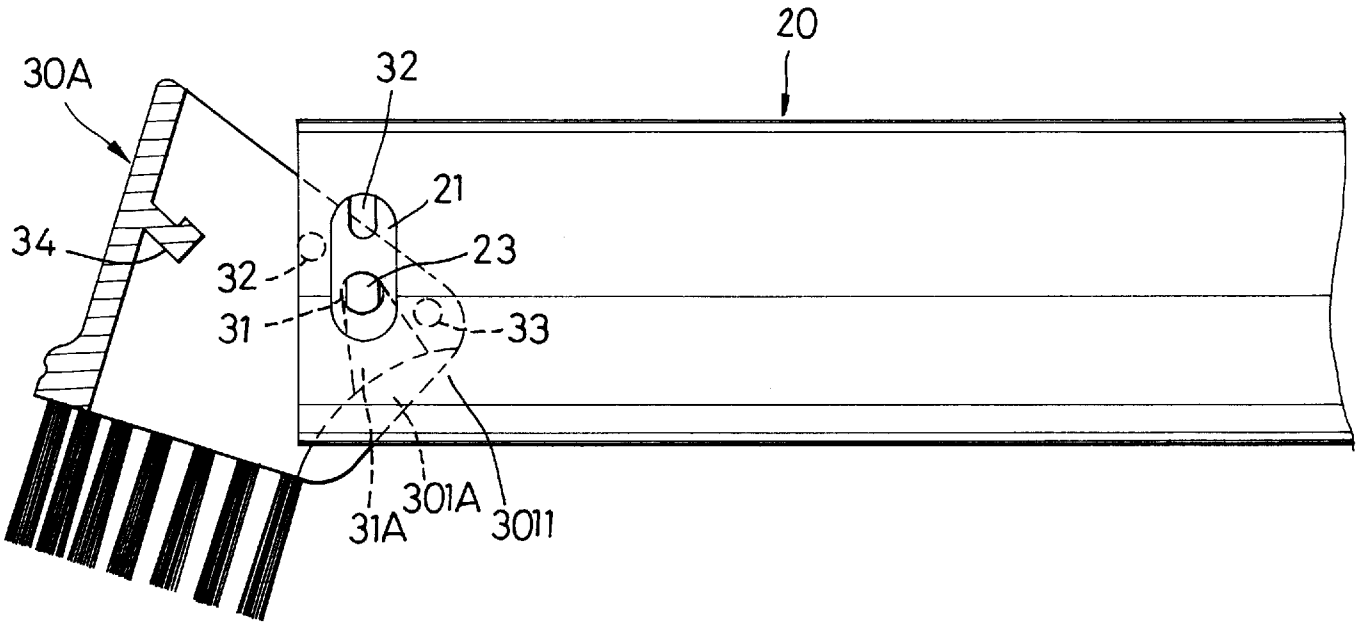
FIG. 4 depicts how the brush member shown in FIG. 3 is mounted to a pipe body of the preferred embodiment of this invention.

Referring to FIGS. 2, 3 and 4, the preferred embodiment of a suction pipe assembly for a vacuum cleaner according to this invention includes a pipe body 20 and a brush member 30.

The pipe body 20 can be connected to a vacuum cleaner in a conventional manner. Since the feature of this invention does not reside in the connection between the pipe body 20 and the vacuum cleaner, a detailed description of the same will be omitted herein. In the preferred embodiment, the pipe body 20 is provided with a distal open end portion 21.

The brush member 30 includes a brush base 30A and a plurality of bristles 30B. The brush base 30A has a generally U-shaped cross section, a rear section 301 that straddles the distal open end portion 21 of the pipe body 20 (see FIG. 5) and that is provided with opposite lateral side portions 301A pivoted respectively to two diametrically opposite positions of the distal open end portion 21 of the pipe body 20, and a front section 302 with a distal front end face 302A. The bristles 30B are disposed on the front end face 302A of the front section 302 of the brush base 30A.

The distal open end portion 21 of the pipe body 20 has an external surface 20A which is embossed so as to form two pivot protrusions 23 (only one is shown in FIG. 2) at the diametrically opposite positions of the pipe body 20. The side portions 301A of the rear section 301 of the brush base 30A have distal bottom end faces 3011 and inner surfaces provided with two pivot grooves 31 for receiving the pivot protrusions 23 respectively, and two diverging entry recesses 31A which extend respectively from the pivot grooves 31 to the bottom end faces 3011 to permit entry of the pivot protrusions 23 into the pivot grooves 31 via the bottom end faces 3011 of the side portions 301A of the rear section 301 of the brush base 30A during assembly of the brush base 30A onto the pipe body 20.

Retaining means is used for retaining releasably the brush base 30A on the pipe body 20 at a position of use and a storing position. The retaining means includes a pair of engagement grooves 22 formed in the external surface of the distal end portion 21 of the pipe body 20, and first and second bosses 32, 33 provided on the inner surfaces of each of the side portions 301A of the rear section 301 of the brush base 30A.

Figure 5:
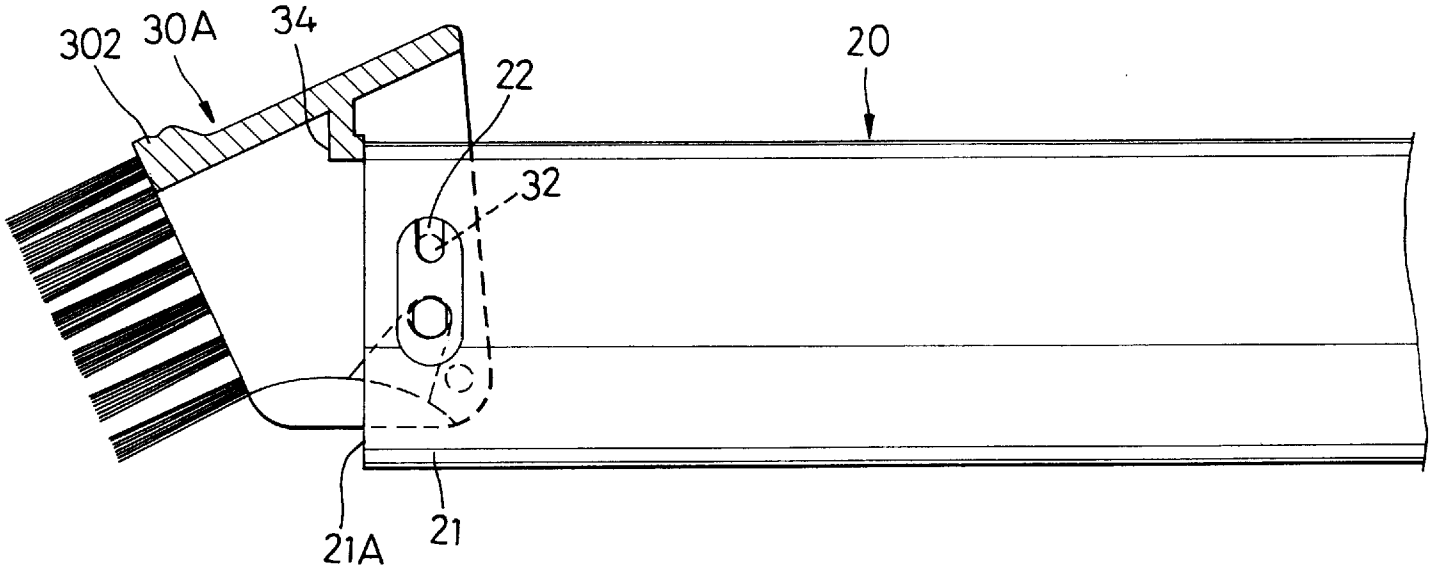
FIG. 5 is a partly sectional view of the preferred embodiment of this invention at a position of use.

As illustrated in FIG. 5, the brush base 30A is pivotable relative to the distal open end portion 21 of the pipe body 20 to the position of use, wherein the front section 302 of the brush base 30A extends frontwardly relative to the distal open end portion 21 of the pipe body 20. At the position of use, the first bosses 32 of the brush base 30A engage the engagement grooves 22 of the pipe body 20.

Figure 6:
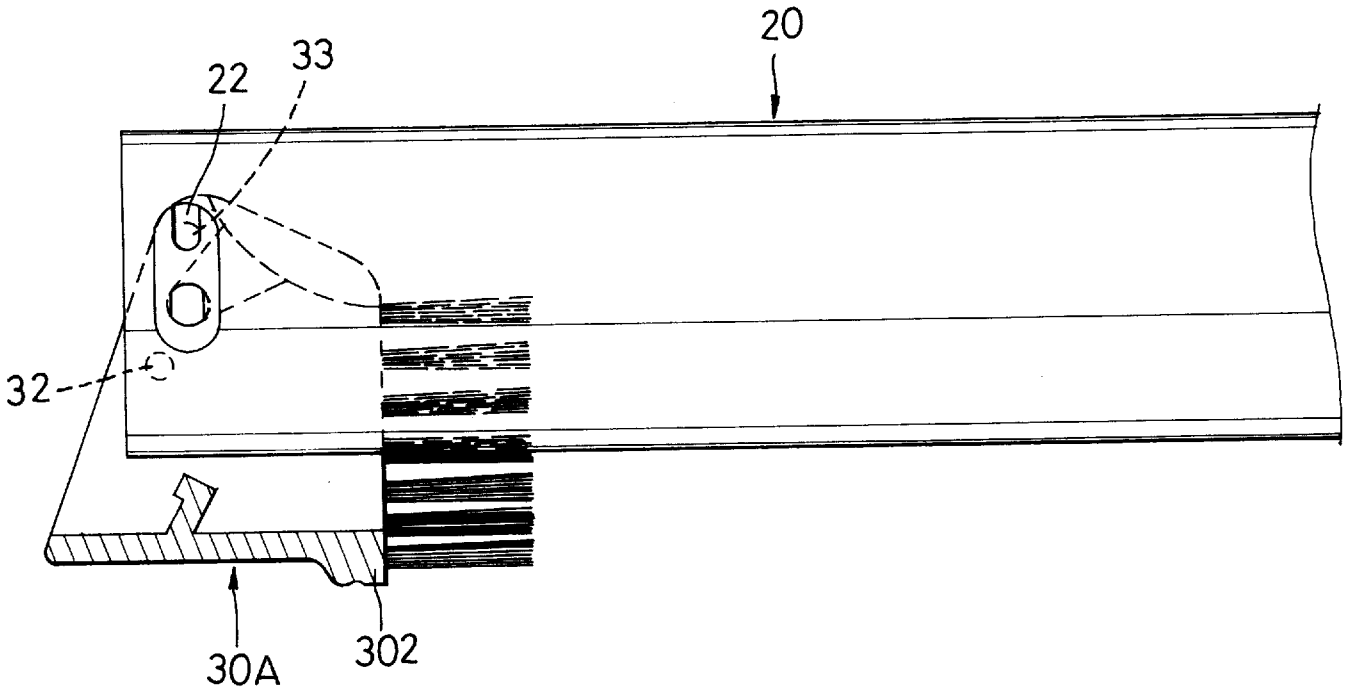
FIG. 6 is a partly sectional view of the preferred embodiment of this invention at a storing position.

As illustrated in FIG. 6, the brush base 30A can be pivoted forcibly from the position of FIG. 5 to the storing position such that the pivoting action of the brush base 30A disengages the first bosses 32 from the engagement grooves 22 and correspondingly enables the second bosses 33 to engage the engagement grooves 22. Under this condition, the front section 302 of the brush base 30A straddles the pipe body 20 and ceases to extend frontwardly relative to the distal open end portion of the pipe body 20.

Referring again to FIG. 5, the brush base 30A further has an L-shaped stop element 34 disposed on the inner surface of the same between the lateral side portions 301A thereof (see FIG. 4) such that the stop element 34 abuts against an end face 21A of the distal open end portion 21 of the pipe body 20 to limit movement of the brush base 30A from the storing position of FIG. 6 to the position of use shown in FIG. 5.

Figure 7:
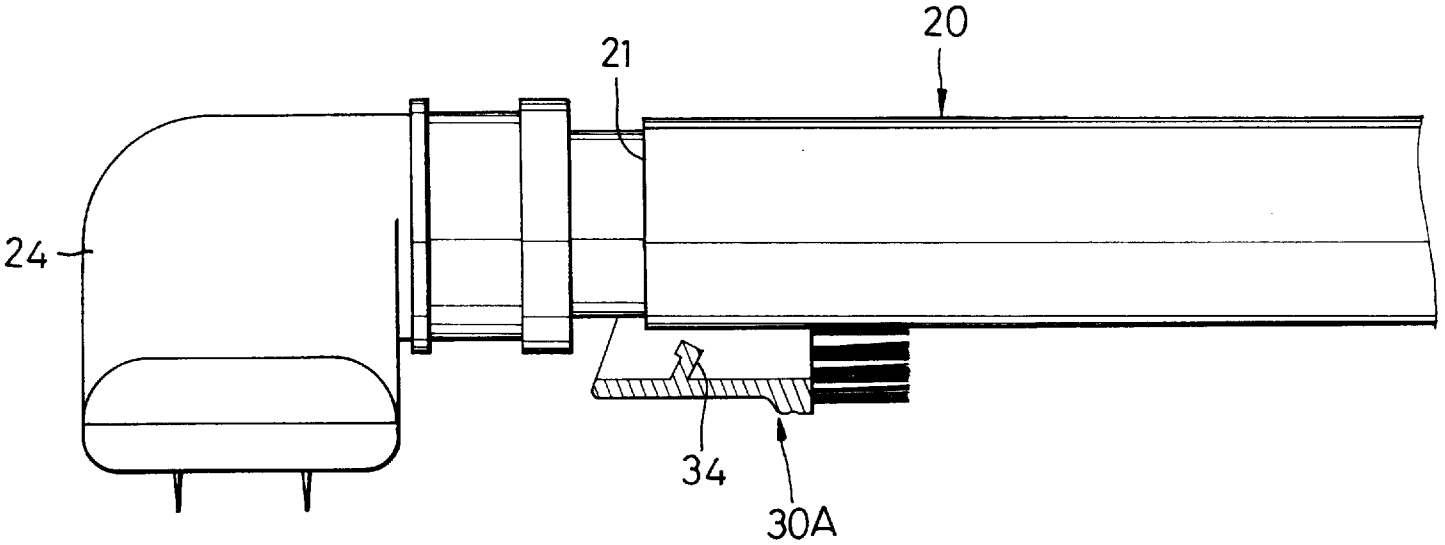
FIG. 7 illustrates how the preferred embodiment can be used with a conventional suction head.

Referring to FIG. 7, when the brush base 30A is at the storing position, the connecting end portion of the conventional suction head 24 can be fitted detachably into the distal open end portion 21 of the pipe body 20.

From the above explanation, it can be understood that misplacing of the brush member 30 can be avoided as the latter is pivoted to the pipe body 20.

With this invention thus explained, it is apparent that numerous modifications and variations can be made without departing from the scope and spirit of this invention. It is therefore intended that this invention be limited only as indicated in the appended claims.

I claim:

1. A suction pipe assembly for a vacuum cleaner, comprising:

a pipe body having a distal open end portion;

a brush member including:

a brush base which has a generally U-shaped cross section, a rear section that straddles said distal open end portion of said pipe body and that has opposite lateral side portions pivoted respectively to two diametrically opposite positions of said distal open end portion of said pipe body, and a front section with a distal front end face; and a plurality of bristles provided on said front end face of said front section;

said brush base being pivotable with respect to said distal open end portion of said pipe body between a position of use, wherein said front section of said brush base extends frontwardly relative to said distal open end portion of said pipe body, and a storing position, wherein said front section of said brush base straddles said pipe body; and retaining means for retaining releasably said brush base on the pipe body at said position of use and said storing position.

2. The suction pipe assembly as defined in claim 1, wherein:

said distal open end portion of said pipe body has an external surface formed with two pivot protrusions at said diametrically opposite positions;

said side portions of said rear section of said brush base having distal bottom end faces and inner surfaces provided with two pivot grooves for receiving said pivot protrusions respectively, and two diverging entry recesses which extend respectively from said pivot grooves to said bottom end faces to permit entry of said pivot protrusions into said pivot grooves via said bottom end faces of said side portions of said rear section of said brush base during assembly of said brush base onto said pipe body.

3. The suction pipe assembly as defined in claim 1, wherein said distal open end portion of said pipe body has an external surface, said side portions of said rear section of said brush base having inner surfaces, said retaining means including a pair of engagement grooves formed in said external surface of said distal end portion of said pipe body, and first and second bosses provided on said inner surfaces of each of said side portions of said rear section of said brush base, said first bosses engaging said engagement grooves when said brush base is at said position of use, said second bosses engaging said engagement grooves when said brush base is at said storing position.

4. The suction pipe assembly as defined in claim 1, wherein said distal open end portion of said pipe body has an end face, and said brush base has an inner surface provided with a stop element that is disposed between said lateral side portions and that abuts against said end face of said distal open end portion of said pipe body to limit movement of said brush base from said storing position to said position of use.

* * * * *